US006164341A

United States Patent [19]

Lindblom

[11] Patent Number: 6,164,341

[45] Date of Patent: Dec. 26, 2000

[54] PNEUMATICALLY SUPPORTED WEAVING SHUTTLE

[75] Inventor: Bo Lindblom, Osby, Sweden

[73] Assignee: Texo AB, Almhult, Sweden

[21] Appl. No.: 08/974,497

[22] Filed: Nov. 19, 1997

[30] Foreign Application Priority Data

Nov. 29, 1996 [SE] Sweden ..... 9604392

[51] Int. Cl.[7] ..... D03D 49/50; D03D 49/66

[52] U.S. Cl. ..... 139/36; 139/188 R; 139/435.5; 139/437

[58] Field of Search ..... 139/435.5, 204, 139/104, 116.1, 36, 188 R, 435.6, 437, 438, 439

[56] References Cited

U.S. PATENT DOCUMENTS

| | | | |
|---|---|---|---|
| 3,461,919 | 8/1969 | Wueger | 139/438 |
| 4,265,278 | 5/1981 | Jassniker | 139/1 C |
| 4,570,682 | 2/1986 | Bachmann | 139/1 C |
| 5,005,609 | 4/1991 | Volland et al. | 139/435.5 |
| 5,034,181 | 7/1991 | Billiu | 264/517 |
| 5,067,527 | 11/1991 | De Jager | 139/435.2 |

*Primary Examiner*—Andy Falik
*Attorney, Agent, or Firm*—Pollock, Vande Sande & Amernick, R.L.L.P.

[57] ABSTRACT

In a weaving machine, the shuttles of the weaving machine are transferred over and across the warp threads of the machine. The method and apparatus have the object of preventing factors which adversely affect the weave result from occurring at high shuttle speeds. One or more air or gas streams (flows) are conveyed from the undersides of the warp threads and upwardly via the warp threads to their upper sides. With the upwardly conveyed air or gas stream, each shuttle is given a lifting movement which prevents burn damages, deformations and wearing of the warp threads due to a high shuttle speed.

6 Claims, 3 Drawing Sheets

PNEUMATICALLY SUPPORTED WEAVING SHUTTLE

FIELD OF THE INVENTION

The present invention relates to a method for use in a weaving machine, in which one or more shuttles are transferred over and across the warp threads of the machine. The purpose of the method is to prevent factors which adversely affect the weave result from occurring at high shuttle speeds, for example, burn damage, deformations and wearing of the warp threads. The invention also relates to an apparatus for use on a weaving machine for the purpose of eliminating or to a large extent counteracting factors having an adverse effect on the weave result.

BACKGROUND OF THE INVENTION

Weaving machines for wire and the like are already well known, and reference may be made in this connection to TEXOS weaving machines T-300 and T-400 which are sold on the open market. A characteristic feature of these weaving machines is the weaving of material with large widths, for example, widths of between 8 and 30 meters. In the known machines, the shuttles are moved across between both sides of the weave material on a race plate or race plates which are supported from beneath by the weave machine's laybeam, with the warp threads lying inbetween.

In weaving machines of this type today, the machines operate with shuttle speeds which are intended to ensure pick densities of 40 picks per minute. The speeds of the shuttles are in this case about 120 m/s, to which must be added considerable accelerations and decelerations at the end positions of the shuttles. There is a need substantially increase in the shuttle speeds to ensure pick densities of no less than 50 to 60 picks per minute, with an associated increase in accelerations and decelerations. These shuttle speeds (of about 130 m/s) have hitherto proven difficult to achieve due to the fact that the construction entails that shuttles with such high speeds have an inappropriate effect on the warp threads. As a result of the warp threads becoming worn, deformed and suffering burn damage, etc., the weave result is impaired, so that the woven product has not been able to live up to the desired quality requirements. The invention aims to solve this problem.

To solve the problem, it is important to use means which can be combined with well proven technology and components. Thus, for example, arrangements should be used which are not too costly and not too technically complicated. It is also expedient that the new function can be added to the weaving machine construction so that the latter does not need to be redesigned. It must be possible for newly manufactured machines as well as already existing machines to be fitted with the new improvements. The invention also solves this set of problems and proposes a solution which, among other things, can be incorporated in a natural way into already existing machinery.

BRIEF SUMMARY OF THE INVENTION

The feature which can principally be regarded as characterizing the novel method is that one or more air or gas streams are conveyed from the underside of the warp threads and upwardly, and the air or gas streams give each shuttle a lifting movement.

In further developments of the method, it is proposed that an inner space of a laybeam included in the weaving machine is connected to one or more compressed air sources, and that quantities of air (airflows) supplied to the inner space from the compressed air source or compressed air sources are forced to pass out via upwardly directed recesses in the laybeam. The air or gas streams can be made to pass through recesses which are arranged above one another and which permit pressure increases in the escaping air in relation to the pressure in the airflows generated by the blower arrangements. Recesses with different cross-sectional areas are placed above one another in order to increase the pressure in the escaping air. In one embodiment, a layer of material, for example a pile mat, is applied on the upper side of the laybeam. First, holes are made in the laybeam material, and the other recesses lying above these are made in the added material. The holes are made in such a way that the recesses in the laybeam have smaller cross-sectional areas than the recesses in the pile mat.

An arrangement having the features characteristic of the invention has one or more energy sources (blowers or blower arrangements) arranged to supply one or more air or gas streams to the undersides of the warp threads at the position of the race plate or race plates. Means are provided to guide the air or gas streams from the underside and up between the warp threads so that they give each shuttle a lifting movement in relation to the warp threads.

In one embodiment, use is made of two energy sources (blower arrangements) which are connected to each end of the weaving machine's laybeam for the purpose of feeding air into the inner space of the laybeam. The laybeam is provided with upwardly directed recesses, by means of which the air supplied from each energy source can be controlled. In a further development, the air is made to pass through recesses which are arranged above one another, where the lower recesses have a cross-sectional area which is smaller than the cross-sectional area of the corresponding upper recess. In one embodiment, a layer of material (pile mat) is fastened to the upper side of the laybeam, and both the laybeam and the layer of material are provided with the said upwardly directed recesses. The speed of rotation of each blower is designed to be controllable, and in one embodiment the speed of rotation of the blower can be controlled from the machine so that the speed of rotation of the blower is high at high pick densities, and vice versa.

ADVANTAGES

Simple blower arrangements can be used. In this way it is possible to avoid expensive solutions using high-pressure blowers. The laybeam in each weaving machine can be simply adapted and can be supplemented with a pile mat or equivalent means in order to obtain an effective shuttle lift function.

DESCRIPTION OF THE FIGURES

A presently proposed embodiment of a method and an apparatus according to the invention will be described hereinbelow with reference to the attached drawings, in which.

DETAILED DESCRIPTION OF THE PREFERRED EMBODIMENTS

Figure 1:
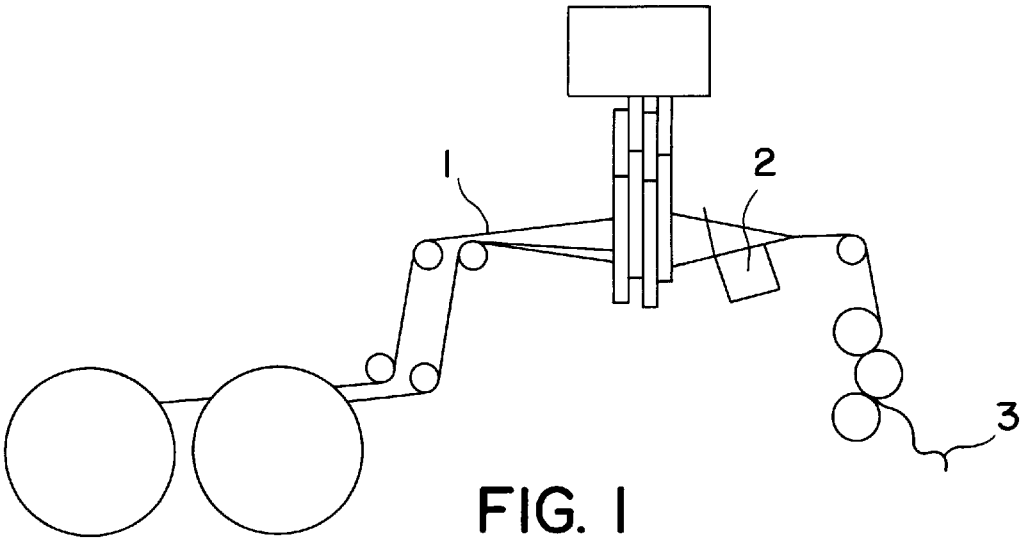
FIG. 1 shows a side view of a known weaving machine which uses lifting systems for the shuttle or shuttles.

In FIG. 1, a weaving machine according to well known principles and construction is indicated by 1. The various parts of the machine will not be described in detail here, and instead reference is made only to the machine's laybeam 2 and to the emerging woven material 3.

Figure 2:
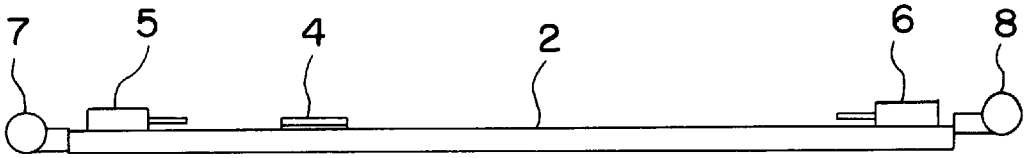
FIG. 2 shows, in a front view of the machine, and on an enlarged scale compared to FIG. 1, the weaving machine's laybeam, race plate, shuttle-activating members and blower arrangement.

According to FIG. 2, one or more shuttles 4 is/are transferred across the machine, over the top of the laybeam 2, with the warp threads (not shown in FIG. 2) lying inbetween. This transfer is effected in a known manner by hydraulic strokes indicated symbolically by 5 and 6. In this illustrative embodiment, the laybeam is square and is connected at its ends to blower units 7, 8. In the illustrative embodiment shown, these are of type 2 BH 1800—1 AC 16 which are sold on the open market by Siemens. A characteristic of the blower units is that they can operate with high flow volume and little pressure. Their speed of rotation is controlled in a known manner they can likewise be controlled in a known manner from the machine so that at high shuttle speeds (which are to ensure pick densities of 50–60 picks/minute) the speeds of rotation of the blowers are higher, and vice versa.

Figure 3:
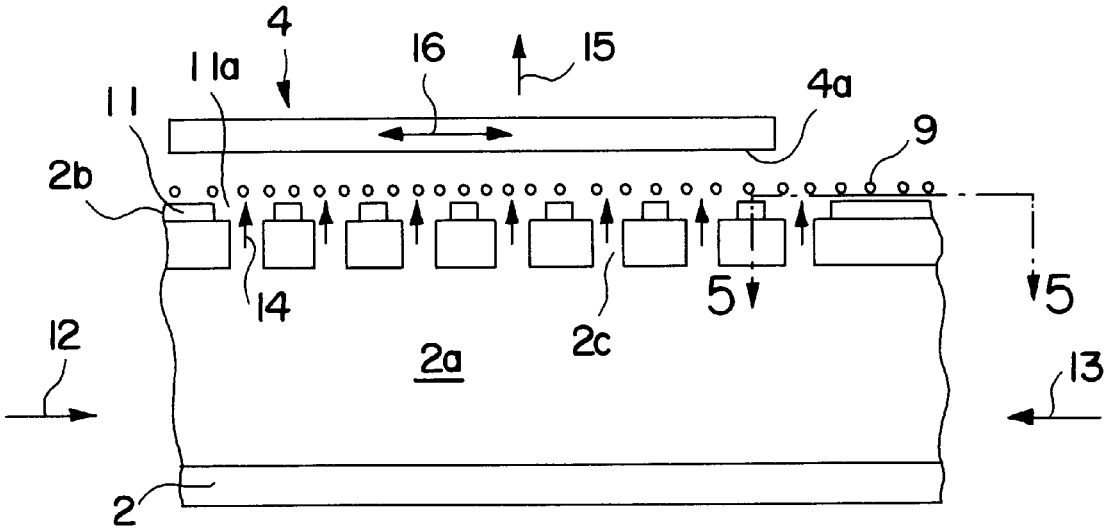
FIG. 3 shows, in a front view of the machine, and on an enlarged scale compared to FIG. 2, the arrangement of recesses in the laybeam for generating powerful upwardly directed air streams.

In FIG. 3, the warp threads extending perpendicularly to the plane of the paper are indicated by 9, and the direction of movement of the shuttle 4 across the warp threads is indicated by 16. The inner space of the laybeam is indicated by 2*a*. A pile mat 11 is fastened, for example by glueing, on the top side 2*b* of the laybeam. The laybeam is provided with upwardly directed recesses 2*c*, and the pile mat is provided with similarly upwardly directed recesses 11*a* which are situated above the recesses 2*c*. A characteristic of the hole arrangement is that the recesses 2*c* have substantially smaller cross-sectional areas (hole diameters) than the recesses (holes) 11*a*. In one illustrative embodiment, the hole diameter of the recesses 2*c* is about 2.5 mm, while the hole diameter of the holes 11*a* in the pile mat is about 7 mm.

The airflows from the blowers 7 and 8 (see above) are indicated by 12 and 13, respectively. The airflows from the blowers result in subsidiary airflows 14 issuing via the recesses 2*c* and 11*a*, which are directed upwards. The airflows are chosen to be of high volume. The actual pressure area (actual inner surfaces of laybeam) is comparatively large, with the result that there is a considerable force which lifts each shuttle. The pressures in the subsidiary airflows therefore assume relatively high values, for example values of 0.1 to 0.3 bar, and preferably about 0.2 bar. The subsidiary airflows 14 pass the warp threads from their undersides to their upper sides. On successive passages of the shuttle 4 over the recesses, the lower surface 4*a* of the shuttle will be exposed to the subsidiary airflows and the shuttle in this way acquires a lifting movement in the direction of the arrow 15, i.e. upwardly and away from the warp threads. The latter are tensioned relatively tight in the machine and, as a result of their shape and their small exposure surfaces, are also less exposed to the lifting forces of the upwardly directed subsidiary air streams.

Figure 4:
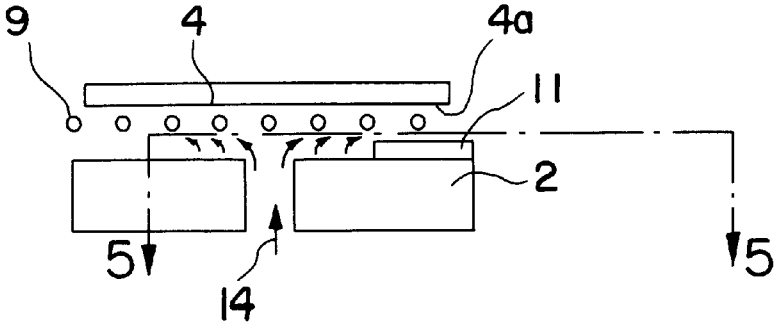
FIG. 4 shows, in cross-section, the design of recesses located above one another in the laybeam and the material (pile) arranged thereon.

According to FIG. 4, each subsidiary air stream 14 spreads out and extends over the lower surface 4*a* of the shuttle, and the shuttle in this way acquires an extended support from each subsidiary air stream. The pile mat is in this case about 2 mm thick.

Figure 5:
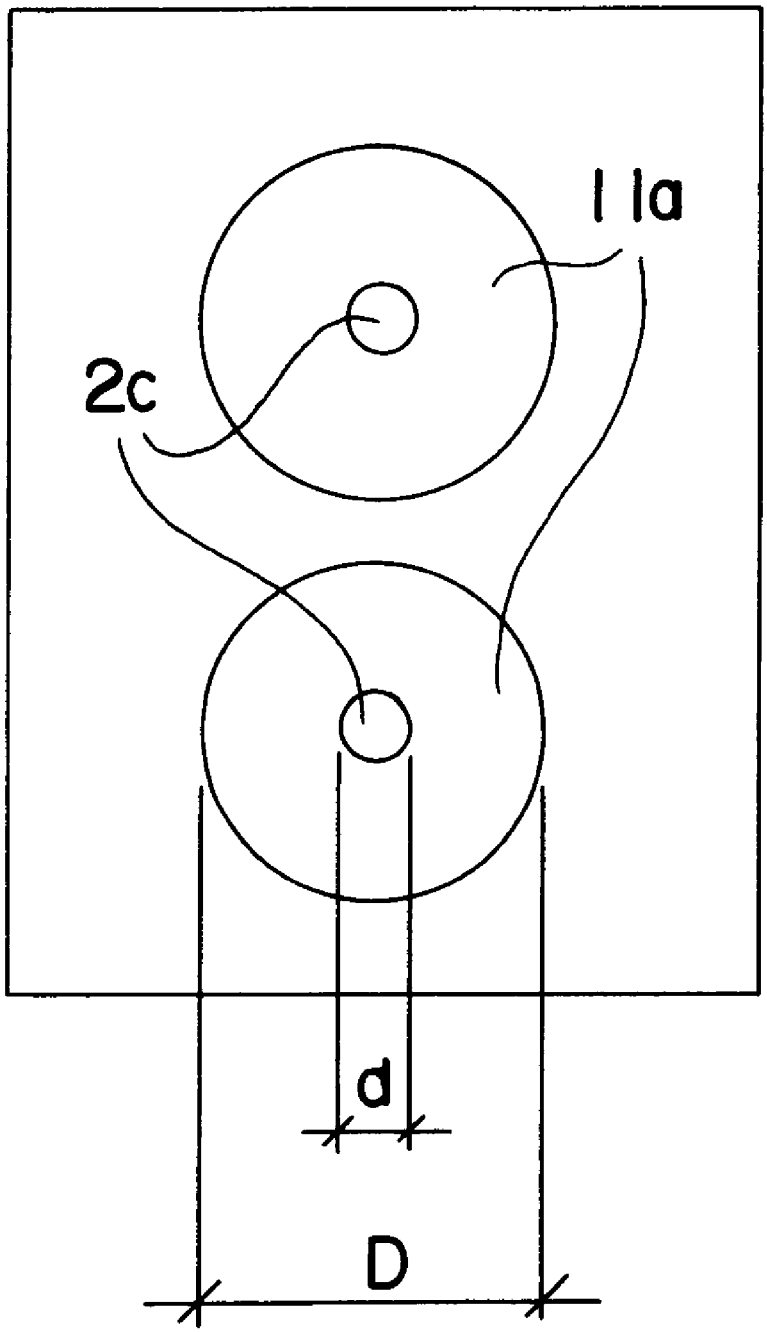
FIG. 5 shows, in a horizontal view, the arrangement of holes according to FIG. 4.

In FIG. 5, the diameters of the said holes 2*c* and 11*a* are indicated by d and D, respectively, which can assume values of, for example, between 1 and 3 mm, preferably about 2 mm, and, respectively, between 5 and 10 mm, preferably about 7 mm.

Tests have shown that the friction between the shuttle and the warp threads is substantially reduced. The adverse effects on the warp threads, discussed above, can in this way be effectively avoided.

The invention is not limited to the embodiment shown by way of example hereinabove, but can be modified within the scope of the attached patent claims and the inventive concept.

What is claimed is:

1. A method for use in an apparatus having at least one shuttle which is transferred over and across warp threads, for preventing damage to the warp threads due to high shuffle speeds, said method comprising the steps of:

directing at least one airstream along the undersides of the warp threads and upwardly;

providing by said airstream a lifting movement to the shuttle;

providing a laybeam having an inner space; and connecting at least one compressed air source to the inner space;

forcing an airflow from the air source to exit the inner space through upwardly directed recesses in the laybeam;

providing a plurality of layers having recesses for the exit of said airflow; and forming the recesses in a lower layer with smaller cross-sectional areas than the recesses in an upper layer.

2. The method of claim 1, wherein said lower layer comprises a portion of the laybeam.

3. The method of claim 1, wherein said upper layer comprises a pile mat.

4. An apparatus for improving the weave result of a weaving machine having at least one race plate, at least one shuttle which is transferred over and across warp threads and a laybeam having an inner space, by preventing damage to warp threads due to high shuttle speeds, said apparatus comprising:

at least one energy source for supplying air or gas flows to the undersides of the warp threads at the position of the race plate or race plates; and means for guiding the air or gas flows from the undersides of the warp threads and up between the warp threads, to give a lifting movement to the at least one shuttle relative to the warp threads, and two energy sources connected to each end of said laybeam having said inner space, for feeding air into the inner space, the laybeam further comprising upwardly directed recesses for controlling the flow of air fed in by the energy sources; and wherein said upwardly directed recesses comprise a plurality of layers of material having recesses, the recesses in a lower layer having smaller cross-sectional areas than the recesses in an upper layer.

5. The apparatus of claim 4, wherein said lower layer comprises laybeam material.

6. The apparatus of claim 4, wherein said upper layer comprises pile mat material.

* * * * *